US005437497A

United States Patent [19]

Hutson

[11] Patent Number: 5,437,497

[45] Date of Patent: Aug. 1, 1995

[54] HEIGHT ADJUSTABLE WHEELCHAIR SEAT

[76] Inventor: Kelly Hutson, 7006 N. 65th Ave., Omaha, Nebr. 68152

[21] Appl. No.: 272,595

[22] Filed: Jul. 11, 1994

[51] Int. Cl.[6] ..... A47C 3/20; A47C 3/32

[52] U.S. Cl. ..... 297/338; 297/DIG. 4; 280/250.1

[58] Field of Search ..... 297/338, 378.12, DIG. 4; 280/304.1, 250.1; 5/DIG. 937

[56] References Cited

U.S. PATENT DOCUMENTS

| | | | |
|---|---|---|---|
| 2,432,936 | 12/1947 | Ross | 155/131 |
| 3,076,678 | 2/1963 | Griffin | 297/339 |
| 4,044,850 | 8/1977 | Winsor | 180/9.2 |
| 4,192,546 | 3/1980 | Smith | 297/DIG. 4 |
| 4,507,814 | 4/1985 | Zyki, Jr. | 5/84 |
| 4,592,570 | 6/1986 | Nassiri | 297/378.12 |
| 4,886,288 | 12/1989 | Dysarz | 280/250 |
| 4,934,723 | 6/1990 | Dysarz | 280/250.1 |
| 4,955,624 | 9/1990 | Jeun-Long | 280/42 |
| 4,993,736 | 2/1991 | German et al. | 280/304.1 |
| 5,035,467 | 7/1991 | Axelson et al. | 297/DIG. 4 |
| 5,039,165 | 8/1991 | Rothman et al. | 297/338 |
| 5,060,960 | 10/1991 | Branscumb et al. | 280/250.1 |
| 5,076,390 | 12/1991 | Haskins | 280/250.1 |
| 5,209,322 | 5/1993 | McMahon | 180/271 |

*Primary Examiner*—Peter R. Brown
*Assistant Examiner*—Anthony Barfield
*Attorney, Agent, or Firm*—John A. Beehner

[57] ABSTRACT

A vertically adjustable seat apparatus and method for a conventional wheelchair having a pair of horizontally spaced seat support bars running front to back of the wheelchair and which are supported in position by a pair of cross-bars. The adjustable seat has a substantially flat seat and a plurality of belt means adapted to support the seat and running along the underside thereof. A locking means is associated with each of the belt means for releasably locking the belt means at a desired length corresponding to a distance below the support bars at which the seat will be positioned. A plurality of hook means is adapted to be slidably received on the belt means and adapted to releasably engage the seat support bars and support the seat in the desired vertical position.

10 Claims, 5 Drawing Sheets

HEIGHT ADJUSTABLE WHEELCHAIR SEAT

BACKGROUND OF THE INVENTION

1. Technical Field

The method and apparatus of the present invention relate generally to wheelchair seats. More specifically, they relate to an apparatus and method wherein the height of a wheelchair seat is continuously adjustable throughout its operating range. The improved, adjustable wheelchair seat is adapted to be used on wheelchairs having a conventional construction and does not require any substantial modification of an existing wheelchair but instead requires only the removal of the conventional seat. The seat requires no tools for adjusting its height.

Currently, most wheelchair seats if they can be adjusted at all, are adjustable only in specific discrete steps. Thus, depending on the gradations of adjustment positions, the user may not be able to find the proper height.

Additionally, some of these seats are unable to be adjusted for different front and rear heights. Such an uneven adjustment might be desirable in the case of a person having a tendency to lean forward in the seat with the possibility of falling out of the chair. Consequently, it is sometimes good to have a seat which could be adjusted for a greater height in the front than in the rear thus urging the person backwards and against the seat back, tending to keep them in the chair.

Additionally, a great number of wheelchair patients like to utilize their feet as a source of locomotion by moving their feet on the ground while seated in the chair. The legs and feet have a tendency to remain stronger than the arms and thus can provide for better mobility than use of the arms in conjunction with the drive wheels. Additionally, this provides a source of exercise for the patient. Thus it is important to provide a seat which is adjustable in height so as to permit the patient to place his or her feet on the floor.

2. Description of the Prior Art

As mentioned above, the majority of wheelchairs are not adjustable in height. Rather, the leg rests of the chair are adjusted in height in order to accommodate people of different heights. However, there are some prior art examples of wheelchair seats which may be adjusted in height.

One example of such a prior art height adjustable seat is the "Jay Adjustable Solid Seat". This adjustable seat provides an example of a seat which although adjustable in height, may only be adjustable in discrete positions. Adjustment is made by means of a plurality of hooked bars attached to the horizontal mounting bars of the chair. The hooked bars comprise a discrete number of adjustment locking positions. Therefore, height adjustment is limited to these discrete locking positions, i.e. no "in between" positions. Additionally, a tool is required to make the adjustment between positions.

Another prior art example of a height adjustable wheelchair seat is Griffin, U.S. Pat. No. 3,076,678, which discloses a fabric, hammock-type seat suspended between vertically slidable rods mounted on the wheelchair side posts. The rods are raised and lowered by means of straps which are extended over rollers in the wheelchair arm rests. The straps are trained around an idler roller and drive roller for raising and lowering the seat in response to rotation of the drive roller. Thus, special arm rests and corner posts are required in order to accommodate the idler and drive rollers.

Therefore, it is a primary objective of the present invention to provide a height adjustable wheelchair seat which is adapted for use on conventional wheelchairs without the requirement for special fittings.

Another objective is to provide a seat which requires no tools for adjustment of its height.

Another objective of the present invention is to provide a height adjustable wheelchair seat which may be mounted to a conventional wheelchair without extensive modification thereof.

Another objective of the invention is to provide a height adjustable wheelchair seat which may be adjusted in height continuously throughout the height adjustment range without being limited to discrete positions.

Another objective is to provide a height adjustable seat which may be adjusted to different heights in the front and rear sections thereof.

Another objective is to provide a seat which is constructed of durable material impervious to liquids and the like.

Another objective is to provide a seat comprising a securement means for securing the seat in position once the height adjustment has been made.

Another objective is to provide a seat of a design which may be utilized on wheelchairs having some frame deformities due to extended use.

A final objective is to provide a seat which may be adjustable in height so as to permit a patient to place his or her feet on the floor in order to provide a means of locomotion.

SUMMARY OF THE INVENTION

A vertically adjustable seat apparatus and method for a conventional wheelchair having a pair of horizontally spaced seat support bars running front to back of the wheelchair and which are supported in position by a pair of cross-bars. The adjustable seat has a substantially flat seat and a plurality of belt means adapted to support the seat and running along the underside thereof. A locking means is associated with each of the belt means for releasably locking the belt means at a desired length corresponding to a distance below the support bars at which the seat will be positioned. A plurality of hook means is adapted to be slidably received on the belt means and adapted to releasably engage the seat support bars and support the seat in the desired vertical position.

DESCRIPTION OF THE PREFERRED EMBODIMENT

The need for wheelchairs is increasing dramatically and will continue to increase dramatically with the aging of the "baby boom" generation. The over-65 age group is already the fastest growing segment of the population and will continue to be so. Thus, the use of wheelchairs will continue to escalate into the foreseeable future. Consequently, it is of great importance to provide wheelchairs and wheelchair accessories designed to maximize the comfort and mobility of the people who are confined thereto.

One major concern in the design of wheelchairs and accessories is that patients be provided the maximum opportunity to exercise even while in the chair. One of the most common methods of obtaining some exercise is for the patient to propel themselves by use of the feet, while seated in the chair. Consequently, it is highly desirable to provide a seat which is capable of adjustment in height so as to permit the patient to place his or her feet on the ground. Another concern is for patients having a tendency to lean forward. In addition to stress placed on the back, this condition has the possibility for the patient falling out of the seat. Thus, it is beneficial to provide a seat which is capable of being placed in the chair at a downward angle at the rear thereof so as to encourage the patient backward in the seat.

The present invention meets these objectives. It provides a height adjustable seat which is adapted for easy installation on conventional wheelchairs. Thus, no modification of the chair itself is necessary and the installation of the seat is quite straightforward. Importantly, since the adjustment in height is made by means of a belt and buckle type arrangement, no tools are required. Thus, nursing personnel can make quick on the spot adjustments. Additionally, while simple in its design, it has a number of utilitarian features which make it ideal for this aging population. As described in more detail below in conjunction with the figures, the seat apparatus of the present invention will provide a great benefit to those who need to use a wheelchair.

Figure 1:
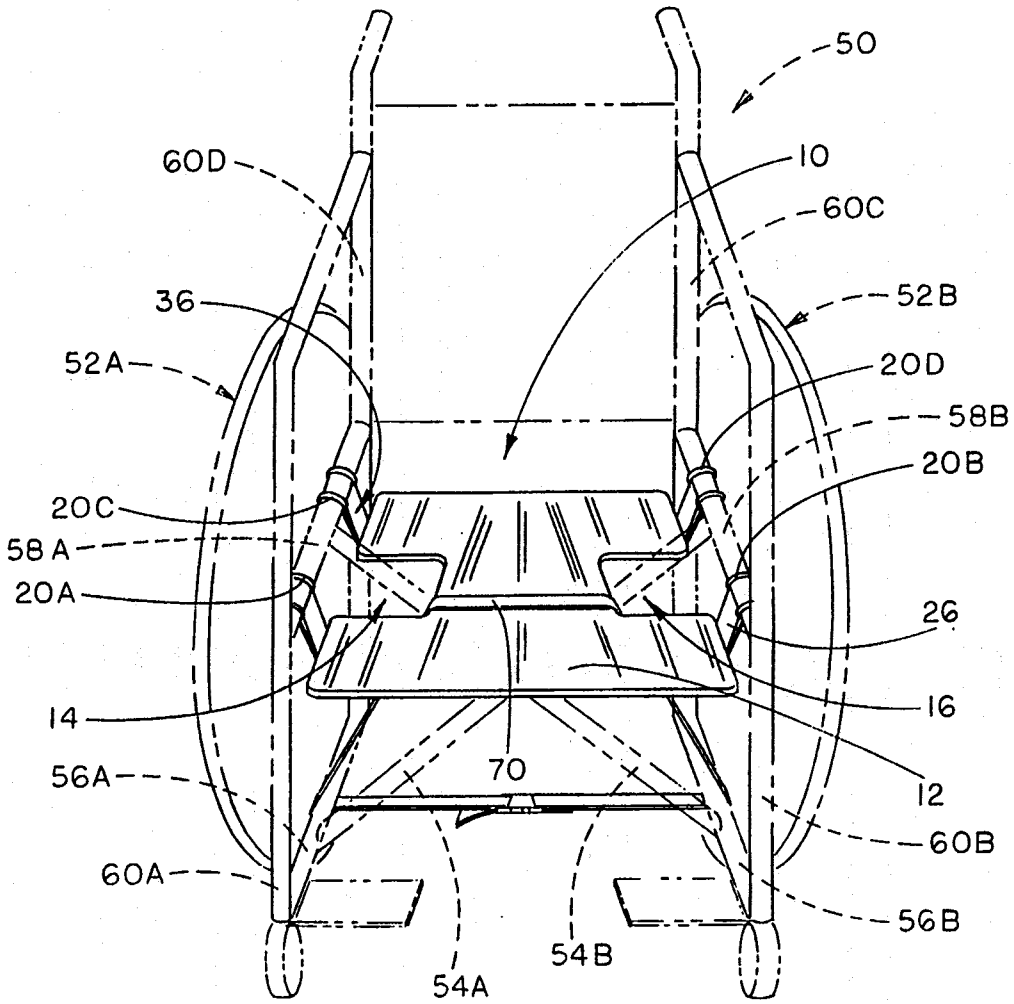
FIG. 1 is a front perspective view showing installation of the height adjustable seat on a conventional wheelchair.

FIG. 1 is a perspective view showing the seat apparatus 10 of the present invention installed on a conventional wheelchair 50 As seen in the figure, a conventional wheelchair 50 comprises left and right wheels 52*a* and *b*, support cross bars 54*a* and *b*. The support cross bars 54*a* and *b* are attached at one end to lower horizontal support bars 56*a* and *b* and at the upper end to horizontal support bars 58*a* and *b*. The seat support frame is completed by vertical support members 60*a, b, c* and *d*. Vertical support members 60*a* and *d* are connected on the lower end to lower horizontal support member 56*a* and at the upper end to upper horizontal support member 58*a*. Vertical support members 60*b* and *c* are connected at the lower end to lower horizontal member 56*b* and at the upper end to upper horizontal support member 58*b*. It is this seat support frame which provides a means for supporting conventional wheelchair seats in addition to the improved vertically adjustable wheelchair seat 10 of the present invention.

Turning now to the improved seat apparatus 10 and its interconnection to the wheelchair 50 and associated support frame, it can be seen from the figure that the seat 10 is supported within the frame by using upper horizontal support bars 58*a* and *b*. As seen in the figure, support hooks 20*a, b, c* and *d* are in contact with, and are hooked along the top of, upper horizontal support bars 58*a* and *b*. Seat 12 in turn is supported by means of front belt 26 and rear belt 36. Front belt 26 is slidably received within hooks 20*a* and 20*b* placed on opposite sides of seat 12. Additionally, rear belt 36 is slidably received within hooks 20*c* and 20*d* placed on opposite sides of seat 12. Seat 12 causes belts 26 and 36 to pull downwardly against hooks 20*a, b, c* and *d* thereby causing them to engage horizontal support bars 58*a* and *b*. Additionally, since the belts 26 and 36 each form a closed loop running along the underside of seat 12, they support seat 12 at a vertical position determined by the length of belts 26 and 36. Belts 26 and 36 each form a closed loop by means of buckles 24*a* and *b* respectively. Buckles 24*a* and *b* are conventional buckles and function in a fashion quite similar to a normal belt buckle in use on trousers and the like. Thus, the length of the belt loop portion 28 and 38 may be lengthened or shortened simply by sliding the belt through buckle 24*a* or *b*. Buckles 24*a* and *b* also provide a fastening means wherein once the loop length has been adjusted to the desired length, the buckle will support the belt at this length when weight is applied to the seat. While shown in a particular configuration in the figures, a virtually limitless number of buckles would be satisfactory as long as they were capable of supporting sufficient weight.

As can be seen from the drawings and as is well understood by principles governing normal trouser belts, the loop length 28 and 38 of belts 26 and 36 will determine the distance downwardly from horizontal support bars 58*a* and *b* at which seat 12 will be positioned. Given a fixed belt length, the shorter the loose portion 30 and 40, the greater the loop portion 28 and 38 and vice versa. Obviously, the greater the belt loop portion 28 and 38 (and consequently the shorter the loose portion 30 and 40, the greater the distance seat 12 will be positioned downwardly from horizontal support members 58*a* and *b*. Conversely, the shorter the belt loop portion 28 and 38 (and consequently the longer the loose portion 30 and 40), the less distance seat 12 will be positioned downward from horizontal support members 58*a* and *b*.

Figure 2:
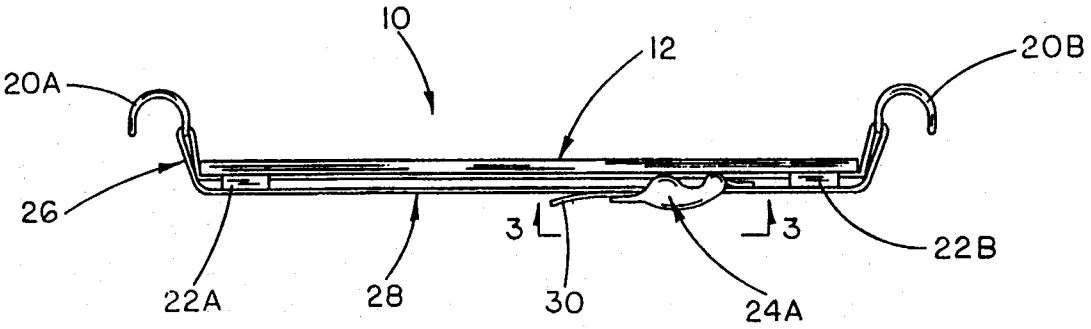
FIG. 2 is a front view of the height adjustable seat and height adjusting belts in addition to mounting hooks.

Belts 26 and 36 and associated buckles 24*a* and *b*, respectively, function in the same manner as a trouser belt. In this regard, the loop portion 28 and 38 of front belt 26 and rear belt 36, respectively, may be adjusted by pushing or pulling loose portion 30 or 40 of front belt 26 or 36, respectively, through buckle 24*a* or *b*. Once the loop portion 28 or 38 has been adjusted to the desired length, the buckle 24*a* or *b* may be utilized to fasten the belt at the desired length. FIG. 2 is a front view of the seat apparatus 10 of the present invention showing in particular the slidable interconnection of the front belt 26 with the belt guide 22*a* and *b*. Also shown in the figure is the slidable reception of belt 26 by hooks 20*a* and *b*. Finally, front buckle 24*a* is shown connecting front belt 26, thereby forming the loop portion 28 and loose portion 30 of front belt.

Figure 3:
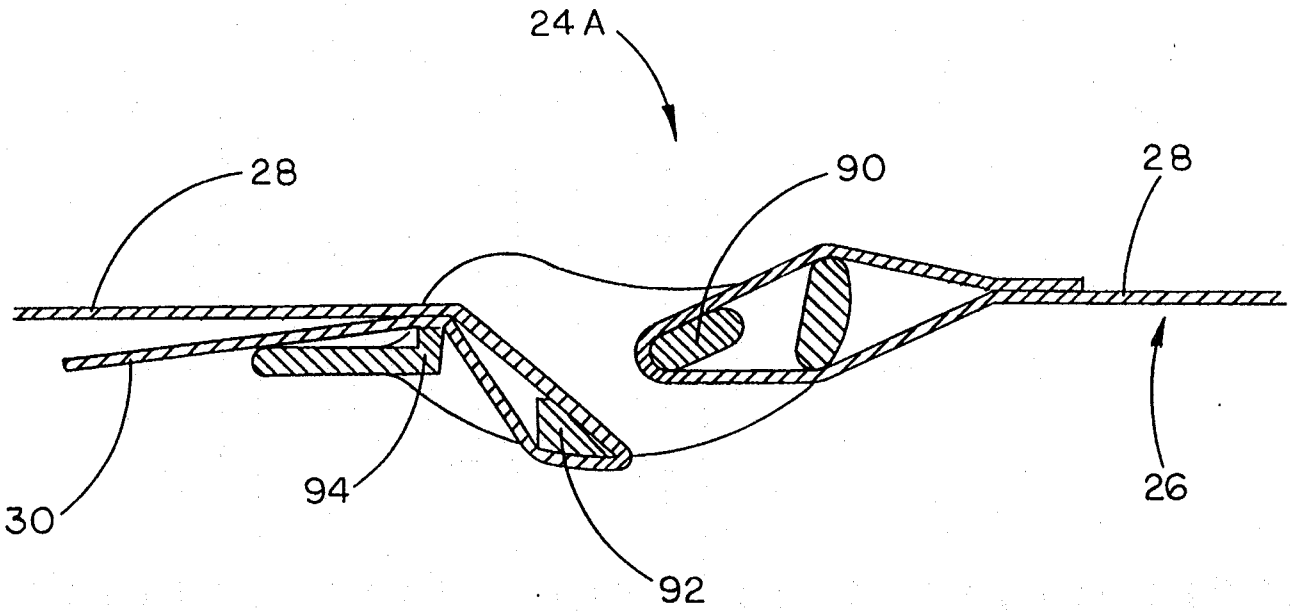
FIG. 3 is a front view of the height adjustable seat showing the height adjusting belt and associated buckle in cross-section.

FIG. 3 is a cross-sectional view of one of the buckles 24*a* used in the present invention to secure belt 26 at the desired length. As seen in the figure, one end of belt 26 is fastened to pin 90 while the other end of belt 26 is adapted to be interwoven between pins 92 and 94 thereby frictionally engaging belt 26 and securing it as the desired length. As described above, securement of belt 26 as described defines a loop portion 28 and loose portion 3 which in turn define the vertical position at which seat 12 will be positioned.

Figure 4:
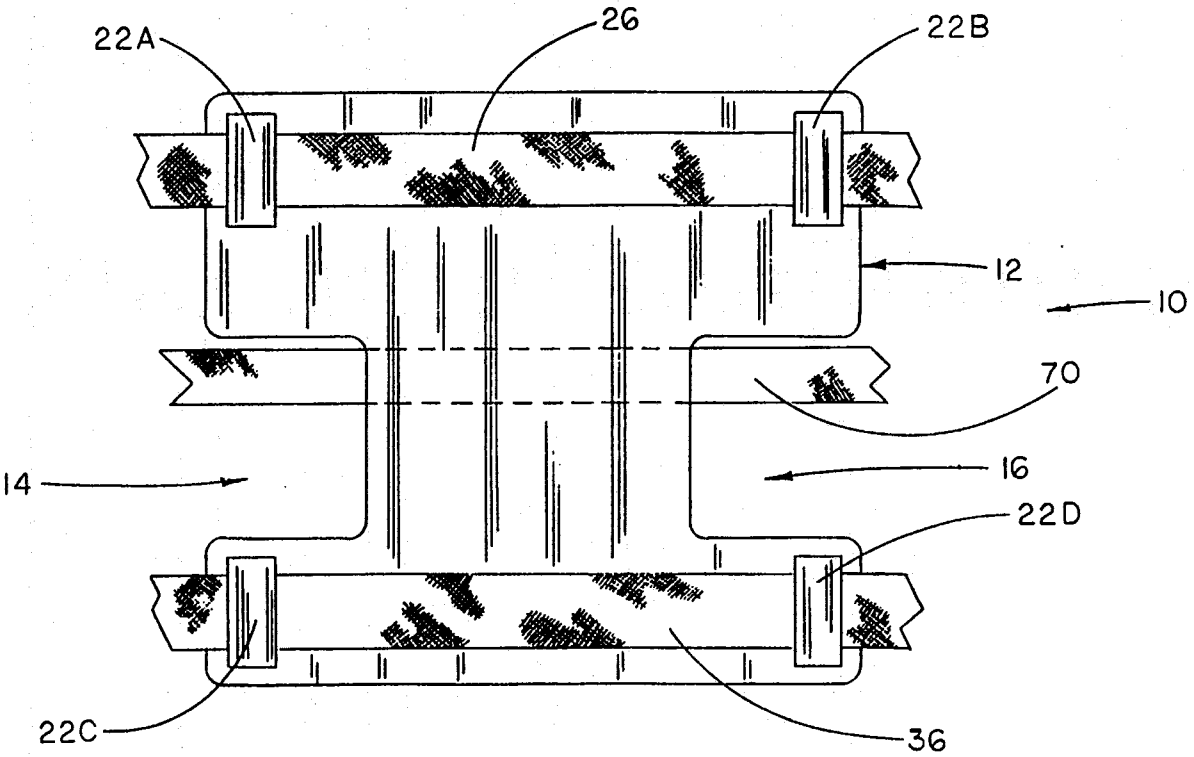
FIG. 4 is a bottom view showing the height adjustable seat and belt retention guides in addition to the rectangular cross mounting bar receiving cutouts.

FIG. 4 is a bottom view of the vertically adjustable seat apparatus 10 of the present invention showing with particular clarity the slidable reception of belts 26 and 36 by their respective belt guides. As seen in the figure, front belt 26 is adapted to be slidably received by belt guides 22*a* and 22*b*, and rear belt 36 is adapted to be slidably received by guides 22*c* and 22*d*. The main purpose for guides 22*a–d* is to provide a means for restricting the lateral or front-to-back motion of the belts while still providing a means for the belt to be slid through the guides so that its loop length 28 and 38, and thereby the seat height, may be adjusted. Also seen in this view with particular clarity are the cutout sections 14 and 16 which are adapted to receive cross bar mounting members 54*a* and *b* seen in FIG. 1. Cutout sections 14 and 16 therefore provide a means for the seat to be adjusted upwardly or downwardly over cross bar mounting members 54*a* and *b*. Also shown is support strap belt 70 which is adapted to be secured to the top surface of seat 12 by means of velcro or the like and to be fastened around support bars 56*a* and *b* (FIG.1) so as to secure seat 12 into position and restrict any substantial vertical movement.

Figure 5:
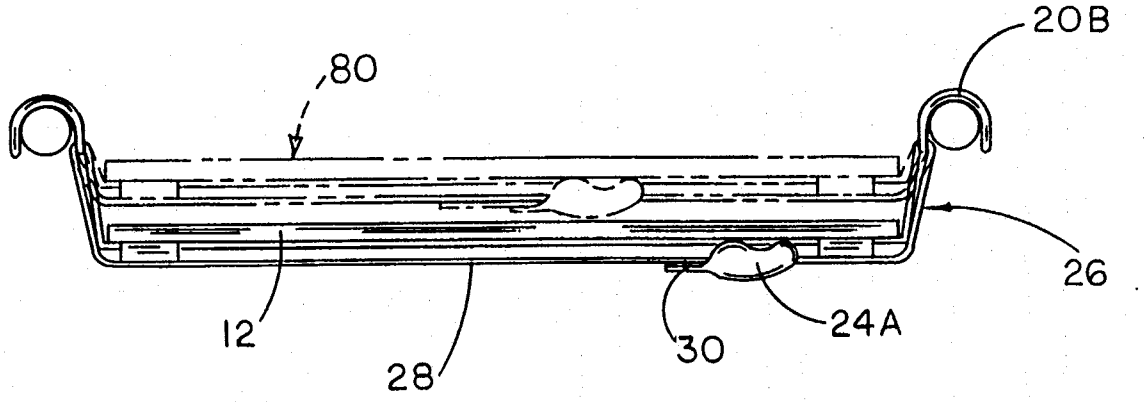
FIG. 5 is a front view of the height adjustable seat showing in hidden lines the seat in different height positions

FIG. 5 is a side view of the vertically adjustable wheelchair seat apparatus 10 of the present invention showing clearly the vertical adjustment range thereof. Shown in the figure is phantom line 80 representing the highest vertical position available for the seat apparatus 10. Front belt 26 is positioned at generally the forward portion of seat 12 whereas rear belt 36 is positioned generally at the rearward end of seat 12 thereby providing maximum lateral stability for seating. The downward adjustment is sufficiently low that even with the seat cushion installed it is low enough to accommodate even the shortest patients.

Figure 6:
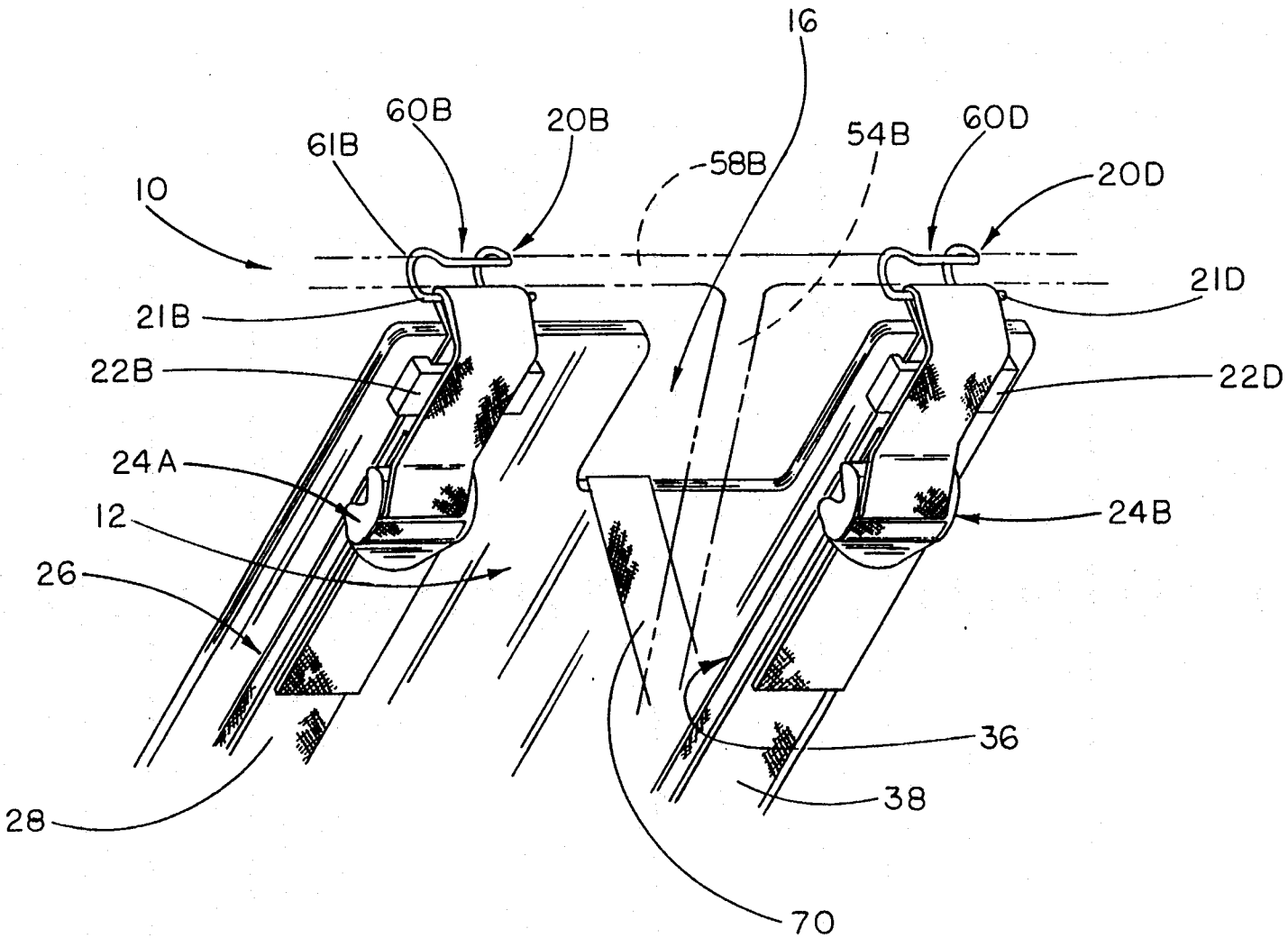
FIG. 6 is a perspective view from the lower side of the seat showing installation of the seat in a conventional chair.

FIG. 6 is a perspective view showing details of the slidable interconnection between the belts and support hooks and the horizontal support bar. While FIG. 6 illustrates two of the four support hooks, the interconnection between the belt, hook and horizontal support bar is similar for the remaining hooks. As seen in the figure, loop portion 28 of belt 26 is adapted to be slidably received within opening 60*b* of hook 20*b* and to frictionally engage lower bar 21*b* of hook 20*b*. Loop portion 28 of belt 26 meanwhile continues across the width of chair 50 (not shown) and under seat 12 to opposite supporting hook 20*a* (not shown) which is similarly engaged by horizontal support member 58*a* (not shown). Thus, loop 28*a* of belt 26 provides a sling-like mechanism to support seat 12 in conjunction with support hooks 20*a* and 20*b*. Meanwhile, the downwardly directed arches 61*a* and *b* provide a means for hook 20*b* to engage horizontal support bar 58*b*. Thus, the weight of seat 10 is partially supported by horizontal support bar 58*b* through loop portion 28 of belt 26 in conjunction with hook 20*b*. As mentioned previously, similar physical interconnection of the remaining hooks, belts, and horizontal support members provide a means for supporting seat 12 at a predetermined vertical position. Also shown is stability support strap 70 adapted to provide additional downward pressure to stabilize the seat in position. And finally, stability strap 70 is shown engaging the lower horizontal support members 56*a* and *b*. As discussed above, stability strap 70 provides a means for releasably retaining seat 12 in the desired vertical position and inhibiting any upward movement of seat 12.

Also clearly visible in the figure, is loose portion 30 of belt 26. As described above, the lengths of loose portion 30 and looped portion 28 of belt 26 are inversely proportional. The greater the length of loose portion 30, the smaller looped portion 28 and vice versa. Buckle locking means 24 is adapted to secure looped portion 28 and loose portion 30 in proper proportion once the adjustment has been made. In the preferred method of adjustment of seat height, buckle 24*a* and *b* would be loosened and the looped portions 28 and 38 of belts 26 and 36, respectively, would be adjusted to the proper length to accommodate the desired seat height. Once the loop length adjustment has been made, buckles 24*a* and *b* would be locked, thereby securing looped portions 28 and 29 at the proper length. As discussed above, the length of looped portions 28 and 38 determine the vertical height at which seat 12 will be positioned. The greater the loop portion length, the greater the distance between hooks 20*a–d* and seat 12 and therefore the lower seat 12 will be positioned. Conversely, the shorter the loop, the nearer hooks 20*a–d* will be positioned to seat 12 and the higher seat 12 will be positioned in the wheelchair. As shown in FIG. 6, the dimensions of belt guides 22*a–d* are sufficiently great to permit lengthwise movement therethrough of belts 26 and 36. However, belt guides 22*a–d* prevent lateral, front-to-back, motion of the belts. Therefore, belt guides 22*a–d* while permitting adjustment of belt loop lengths while at the same time assuring that the belts remain properly positioned for support under seat 12.

It is obvious that numerous other modifications and variations of the present invention are possible in view of the above teachings. For example, the dimensions of the seat 12 may be adjusted in order to fit a particular, specially designed wheelchair. Additionally, the design of the hooks may be altered in order to accommodate the particular design of the support members. For example, the diameters of hooks 20*a–d* may be decreased slightly so as to be slightly less than bars 58*a* and *b* thereby providing a tight frictional engagement thereof.

Therefore it is to be understood that the above description is intended in no way to limit the scope of protection of the claims and is representative of only one of several possible embodiments of the present invention.

Therefore, there has been shown and described an invention which accomplishes at least all of the stated objectives.

I claim:

1.A vertically adjustable seat for a wheelchair having a pair of horizontally spaced seat support bars running front to back of the wheelchair and which are supported in position by a pair of cross-bars, the seat comprising:

a substantially flat support surface having top and bottom surfaces;

a plurality of belt means positioned adjacent said bottom surface and adapted to support said support surface;

locking means connected to each of said belt means for releasably locking said belt means at a desired length said desired length for positioning said substantially flat support surface a distance below the support bars and thereby corresponding to a specific height position of said substantially flat support surface; and a plurality of hook means adapted to be slidably received on said belt means and adapted to releasably engage the seat support bars and support said substantially flat support surface in cooperation with said belt means such that upon said belt length is adjusted to be desired length, and said substantially flat support surface is place on said belt means for positioning the seat support bars, said hook means may be releasably engaged with the bars thereby allowing gravity to settle said hook means against the support bars thereby supporting said substantially flat support surface at the desired height.

2. The invention of claim 1 further comprising a means on said support surface for positioning said belts adjacent thereto.

3. The invention of claim 2 wherein said positioning means comprises a plurality of brackets on said bottom surface of said support surface and adapted to slidably receive said belts.

4. The invention of claim 1 wherein said seat is generally square shaped having front, rear, and two sides and wherein said seat further comprises a notch in each of said two sides adapted to receive the support crossbars when said support surface is lowered

5. The invention of claim 1 wherein said locking means is a strap buckle having a capacity of approximately 600 pounds.

6. The invention of claim 1 further comprising a stability strap adapted to engage the wheelchair at a position lower than said substantially flat surface and secure said substantially flat surface in position once said height adjustment has been made.

7. A vertically adjustable seat for a wheelchair having a pair of horizontally spaced seat support bars running front to back of the wheelchair and which are supported in position by a pair of cross-bars, the seat comprising:

a substantially flat support surface having top and bottom surfaces;

a plurality of belt means positioned adjacent said bottom surface and adapted to support said support surface;

means associated with said seat for positioning said support surface relative to said belt means;

locking means connected to each of said belt means for releasably locking said belt means at a desired length said desired length for positioning said substantially flat support surface distance below the support bars support surface and thereby corresponding to a specific height position of said support surface; and plurality of hook means adapted to be slidably received on said belt means and adapted to releasably engage the seat support bars and support said support surface in cooperation with said belt means such that upon said belt length is adjusted to the desired length, and said support surface is placed on said belt means for positioned between the seat support bars, said hook means may be releasably engaged with the bars thereby allowing gravity to settle said hook means against the support bars thereby supporting said support surface at the desired height.

8. A method of adjustably supporting a seat in a wheelchair having a pair of horizontally spaced seat support bars running front to back of the wheelchair and which are supported in position by a pair of cross-bars, the method comprising: p1 providing a height adjustable seat having, a substantially flat support surface;

a plurality of belt means positioned adjacent said support surface adapted to support said seat; p2 locking means connected to said belt means; and plurality of hook means slidably received on said belt means;

releasing said locking means;

adjusting the length of said belt means to the desired length corresponding to the desired height;

releasable locking said belt means into position by locking said locking means;

releasably engaging said hook means with the horizontal support bars; and lowering said support surface into position.

9. The method of claim 8 wherein the step of lowering the support surface into position further comprises the steps of:

placing said hook means adjacent the horizontal support bars; and lowering said support surface until the weight of said support surface causes said hook means to engage said horizontal support bars.

10. The method of claim 8 further comprising the step of placing a padded seat cushion on said support surface.

* * * * *